US007743626B2

(12) United States Patent
Buckingham

(10) Patent No.: US 7,743,626 B2
(45) Date of Patent: Jun. 29, 2010

(54) MULTIPLE-BOTTLE GEL-PACK

(75) Inventor: Craig Buckingham, Denver, CO (US)

(73) Assignee: Molson Canada 2005, Toronto, Ontario (CA)

( * ) Notice: Subject to any disclaimer, the term of this patent is extended or adjusted under 35 U.S.C. 154(b) by 1004 days.

(21) Appl. No.: 11/245,681

(22) Filed: Oct. 6, 2005

(65) Prior Publication Data

US 2006/0249407 A1 Nov. 9, 2006

(30) Foreign Application Priority Data

May 6, 2005 (CA) ..... 2506463

(51) Int. Cl.
*F25D 3/08* (2006.01)

(52) U.S. Cl. ..... 62/457.5; 62/530

(58) Field of Classification Search ..... 62/457.1, 62/457.2, 457.3, 457.4, 457.5, 457.8, 371, 62/530

See application file for complete search history.

(56) References Cited

U.S. PATENT DOCUMENTS 2,562,108 A 7/1951 Lutz
3,401,535 A * 9/1968 Palmer ..... 62/457.5
4,286,440 A 9/1981 Taylor
4,554,798 A * 11/1985 D'Amour et al. ..... 62/457.5
4,910,970 A * 3/1990 Keeping ..... 62/250
4,916,923 A 4/1990 Adams et al.
5,095,718 A 3/1992 Ormond et al.
5,101,642 A 4/1992 Alexandrov
5,522,239 A 6/1996 Schwartz et al.
5,901,571 A * 5/1999 Whaley ..... 62/457.5
6,067,813 A * 5/2000 Smith ..... 62/371
6,324,864 B1 12/2001 Stewart et al.
6,405,557 B1 * 6/2002 DeCastro et al. ..... 62/459

* cited by examiner

*Primary Examiner*—Melvin Jones
(74) *Attorney, Agent, or Firm*—Sheridan Ross PC

(57) ABSTRACT

A gel-pack for chilling bottled beverages comprising a flexible plastic envelope, sealed around its perimeter, provided with a spaced array of holes therethrough whereby the gel-pack can be draped over a plurality of beverage bottles, with the necks of the bottles protruding through the holes in the gel-pack.

1 Claim, 5 Drawing Sheets

MULTIPLE-BOTTLE GEL-PACK

FIELD OF THE INVENTION

The present invention relates to the field of food and beverage storage and serving, and in particular provides a freezable gel-pack that is adapted to be draped efficiently over a plurality of bottles simultaneously to cool the contents thereof.

BACKGROUND OF THE INVENTION

Freezable gel-packs for cooling are fairly common, and usually comprise a sealed plastic rectangular envelope, filled with a composition such as a mixture of propylene glycol, carboxymethyl cellulose sodium and water that will retain a gel-like consistency when frozen. These gel-packs are useful for cooling beverage containers because of their flexibility. That is, they can be wrapped or draped around a container to obtain a large degree of surface contact, thereby to enhance cooling of the beverage.

In order to cool, or help keep cool, a number of beverage bottles at one time, gel-packs are not usually the method of choice. This is because if the bottles are standing, it is difficult and inconvenient to squeeze a large number of frozen gel-packs between the bottles. Merely placing the bases of the bottles on the gel-packs is awkward and placing the gel-packs on top of the bottles is inefficient because there is a head space of gas in a bottle above the liquid held therein that will act as an insulator.

As an alternative to gel-packs as described above, a variety of styles of hard ice packs have been developed for use with bottles. These include packs that are shaped to fit between and among bottles, such as the packs shown in U.S. Pat. No. 5,095,718. Such packs are quite efficient, and maintain good surface contact with bottles. However, it is necessary to use a large number of such packs to cool a plurality of bottles, and therefore they will fill a large freezer space when they are being chilled.

A second type of hard freezer pack is shown in U.S. Pat. No. 4,554,798, and comprises a large, rectangular hard pack with holes therein for accommodating the necks of bottles, and shaped cavities associated with the holes, so that this hard pack can be placed on an array of bottles, and rest on the shoulders thereof, with the necks protruding through the holes in the hard pack. This is an efficient device, but large, and therefore inconvenient to chill. Moreover, because it is moulded, it will fit onto only one shape of bottle, whereas beverages are marketed in a variety of bottle shapes.

SUMMARY OF THE INVENTION

The object of the present invention, therefore, is to provide a beverage chilling gel-pack that combines the flexibility and ease of use of a flexible gel-pack with the shape conformity of a hard gel-pack. The present invention achieves this object by providing a large rectangular flexible gel-pack, preferably dimensioned to fit inside a beverage carton or a cooler. A plurality of apertures are formed in the large rectangular gel-pack, in a regular array, so that the flexible gel-pack can be draped over a plurality of beverage bottles simultaneously, with the necks of the bottles passing through the gel-pack. The body of the gel-pack is thereby draped over, and rests on, the shoulders of a plurality of beverage bottles.

In a broad aspect, then, the present invention relates to a gel-pack for chilling bottled beverages comprising a flexible plastic envelope, sealed around its perimeter, provided with a spaced array of holes therethrough whereby said gel-pack can be draped over a plurality of beverage bottles, with the necks of said bottles protruding through said holes in said gel-pack.

The envelope may be made up of a pair of congruent, rectangular, flexible plastic sheets, sealed together around their perimeter.

Preferably, each said hole in said gel-pack is defined by a generally circular sealed seam between said flexible plastic sheets.

In a preferred embodiment of the present invention, the envelope is dimensioned to fit inside a selected beverage carton.

Moreover, the envelope may be provided with a number of holes corresponding with the number of bottles said selected carton is designed to hold, and said holes are arranged in the same pattern as said bottles, whereby said envelope can be draped over all of the bottles in a said selected carton.

The holes in said envelope are preferably dimensioned to fit over the necks of selected bottles and rest on the shoulders thereof.

The said envelope may be provided with six said holes, arranged in a 2×3 array.

The envelope may be provided with twelve said holes, arranged in a 3×4 array.

The envelope may be provided with twelve said holes, arranged in a 2×6 array.

The envelope may be provided with fifteen said holes, arranged in a 3×5 array.

The envelope may be provided with eighteen said holes, arranged in a 3×6 array.

The envelope may be provided with twenty-four said holes, arranged in a 4×6 array.

The envelope may be provided with twenty-eight said holes, arranged in a 4×7 array.

The envelope may be provided with two said holes, arranged in a straight line.

The envelope may be provided with three said holes, arranged in a straight line.

The envelope may be provided with four said holes, arranged in a straight line.

The envelope may be provided with five said holes, arranged in a straight line.

The envelope may be provided with six said holes, arranged in a straight line.

The envelope may be provided with seven said holes, arranged in a straight line.

Each said hole may be dimensioned to fit over the neck of a bottle, whereby said envelope can rest on the shoulders of a plurality of bottles.

The envelope preferably contains a predetermined quantity of a food grade freezable gel.

BRIEF DESCRIPTION OF THE DRAWINGS

The gel may comprise water, propylene glycol and sodium carboxymethyl cellulose.

In drawings that illustrate the present invention by way of example.

DETAILED DESCRIPTION OF THE DRAWINGS

Figure 1:
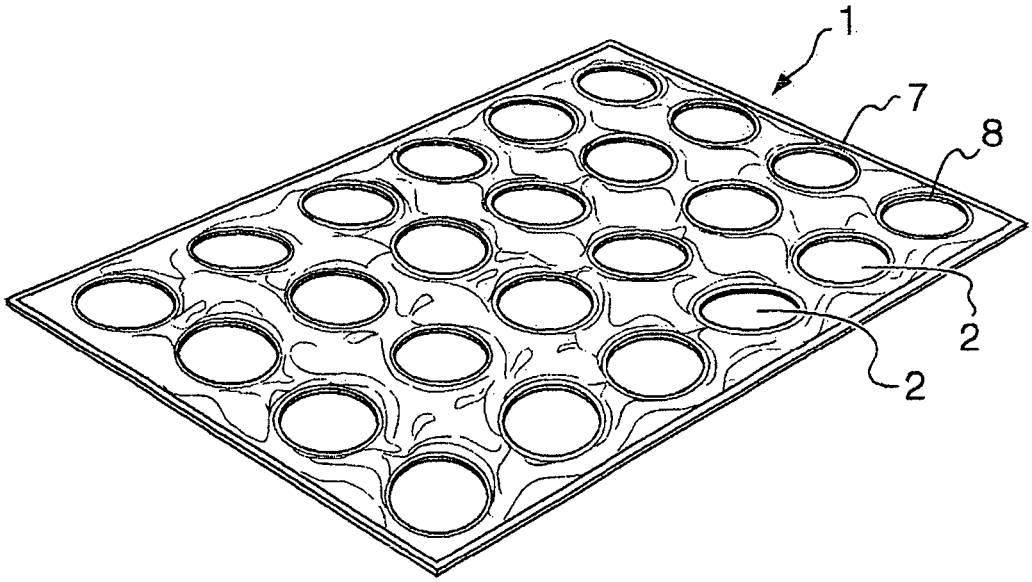
FIG. 1 is a perspective view of the multiple bottle gel-pack of the present invention designed to fit over 24 bottles.

Referring now to FIG. 1 of the drawings, the gel-pack of the present invention is a large rectangle 1, preferably dimensioned to fit snugly inside a beverage carton, covering the entire upper surface thereof.

A plurality of holes 2 are formed in the rectangle, in a regular array, corresponding to the positions of the necks of a plurality of bottles packed in a carton. Each hole 2 is a circle, of a suitable dimension to fit over the top of a bottle without catching on a bottle cap, and without being a tight fit on the neck of a bottle. The diameter of the hole will be selected to fit loosely on the shoulder of a bottle 13, as shown graphically in FIGS. 2 and 3.

Figure 2:
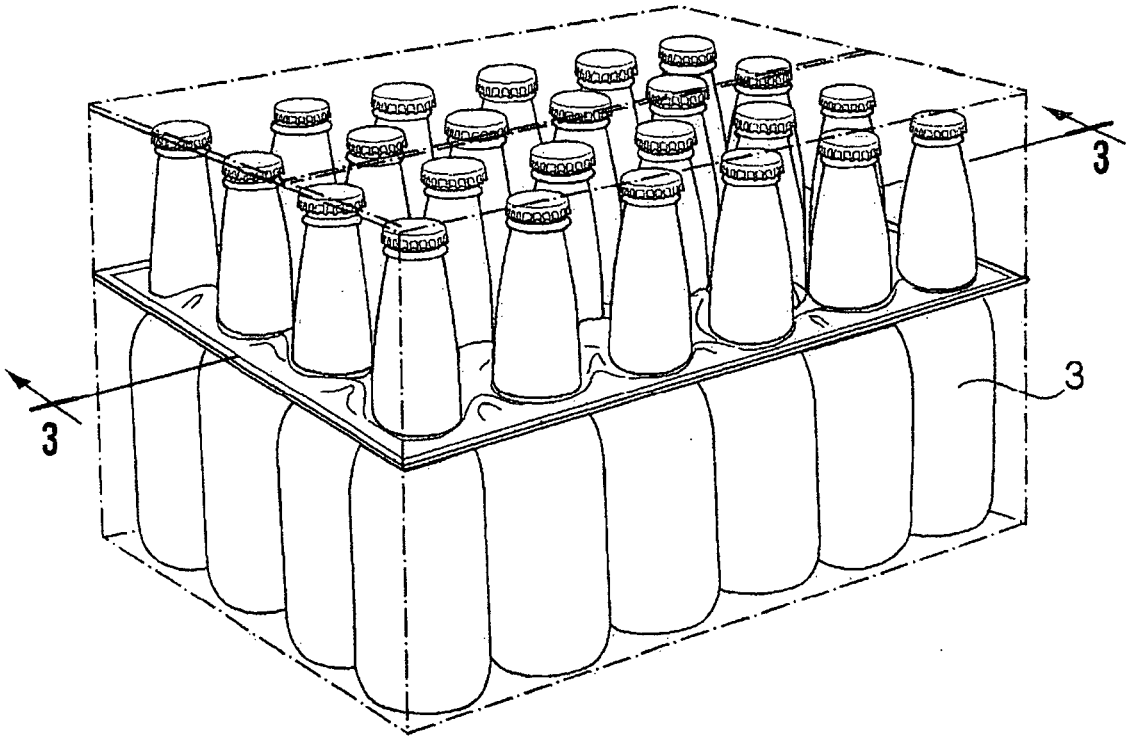
FIG. 2 is a perspective view of the gel-pack of FIG. 1, draped over 24 bottles in a beverage carton.

As shown in FIG. 2, when the gel-pack of the present invention is in place, the necks and tops of all bottles in a carton will protrude through the holes 2 in the gel-pack. The gel-pack, even when frozen, is fairly flexible, so to access a bottle, it need only be lifted off some of the bottles, for instance in the corner of the carton, and then put back in place after the bottle is extracted from the carton.

Figure 3:
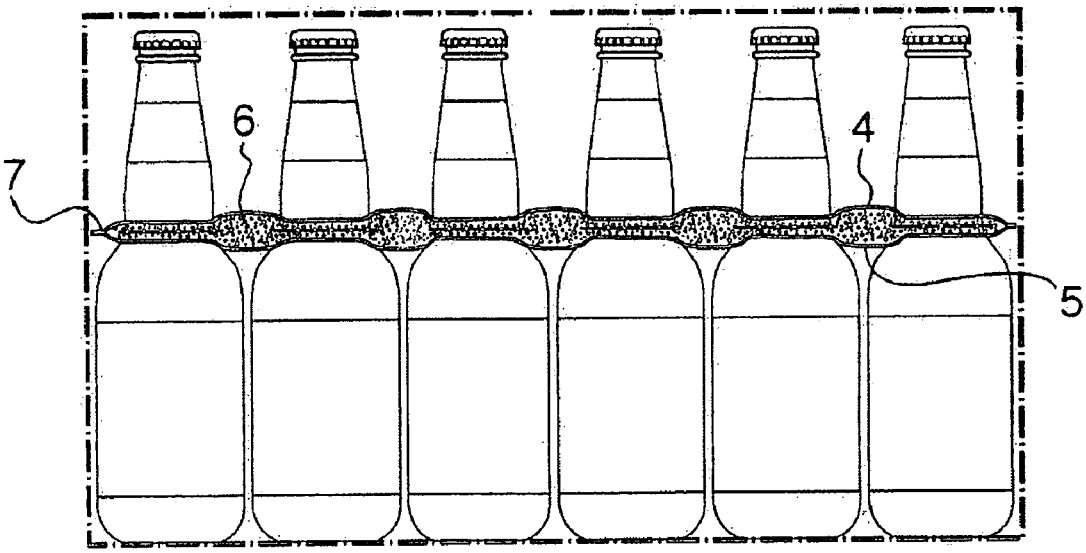
FIG. 3 is a cross-sectional view through line 3-3 in FIG. 2.
Figure 4:
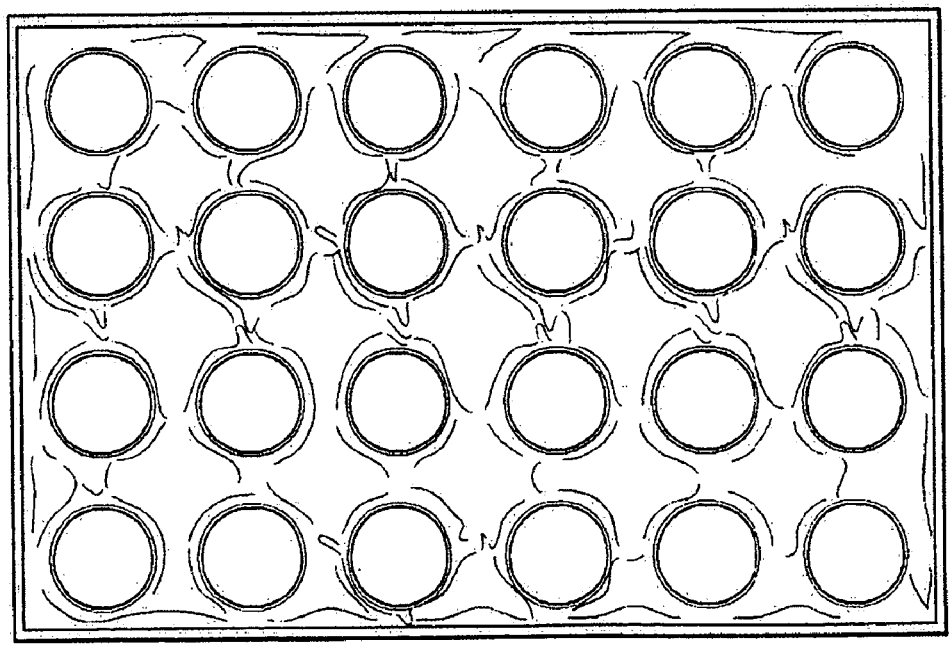
FIG. 4 is a top view of the gel-pack of FIG. 1.
Figure 5:
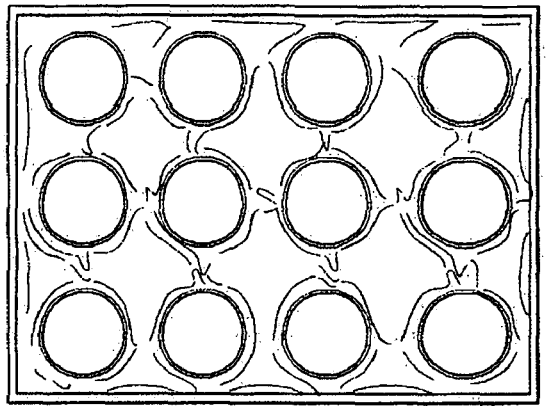
FIG. 5 is a top view of a gel-pack according to the present invention designed to fit over a 3×4 array of bottles.
Figure 6:
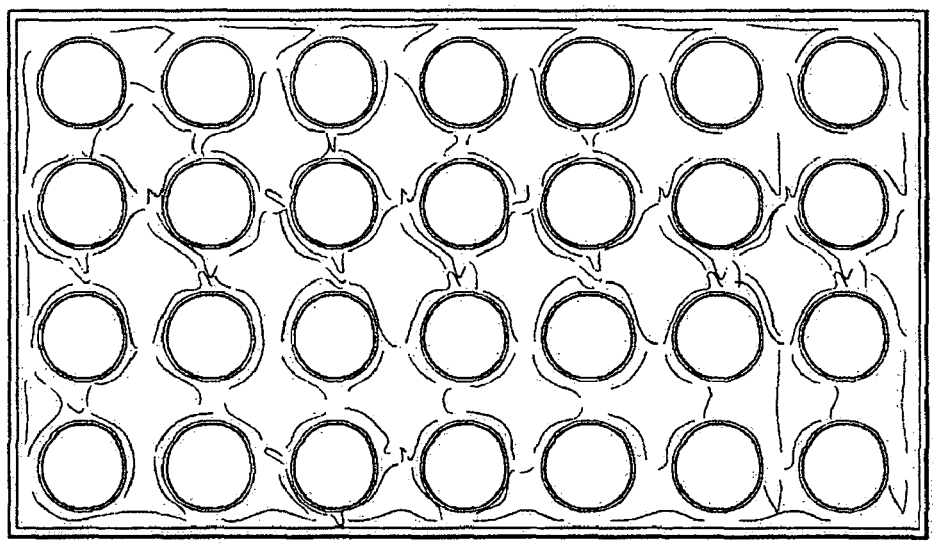
FIG. 6 is a top view of a gel-pack according to the present invention designed to fit over a 4×7 array of bottles.
Figure 7:
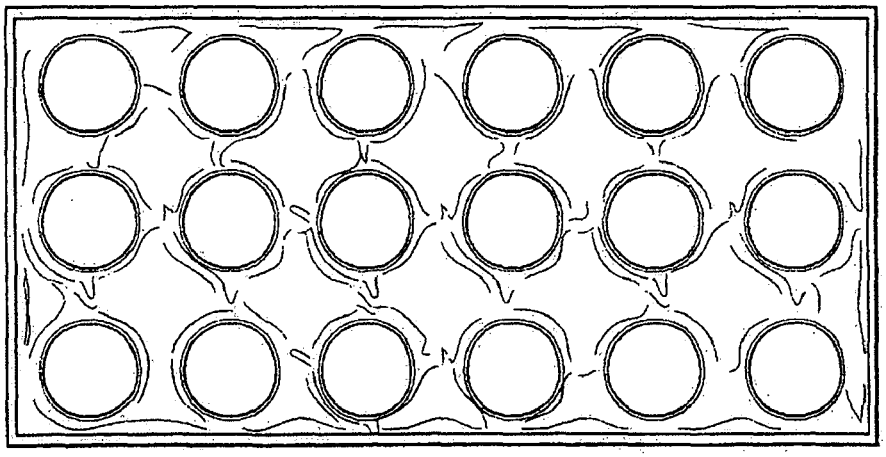
FIG. 7 is a top view of a gel-pack according to the present invention designed to fit over a 3×6 array of bottles.
Figure 8:
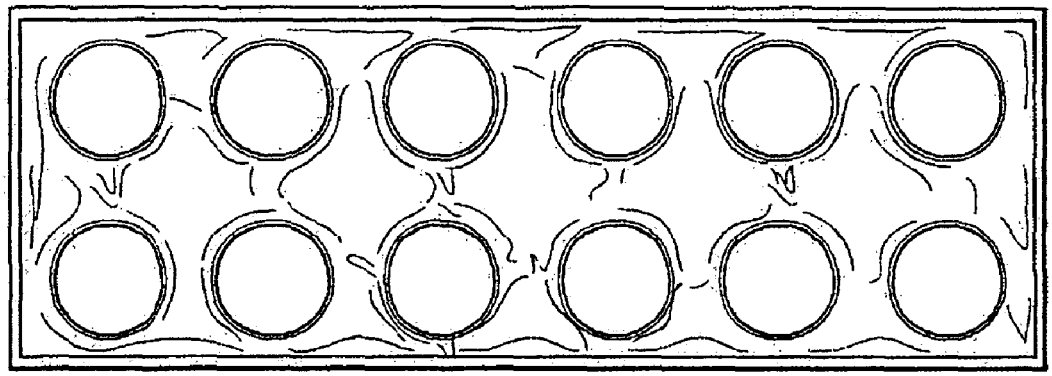
FIG. 8 is a top view of a gel-pack according to the present invention designed to fit over a 2×6 array of bottles.
Figure 9:
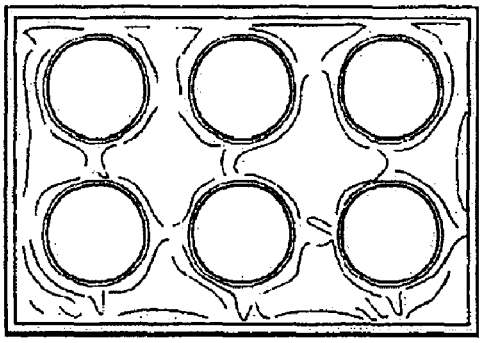
FIG. 9 is a top view of a gel-pack according to the present invention designed to fit over a 2×3 array of bottles.

As can be seen from FIG. 3, when the gel-pack of the present invention is in place, it is in contact with the shoulders of each bottle 3 in the carton, thereby providing high surface area contact. This maximizes the cooling efficiency of the gel-pack of the present invention. Referring to FIG. 3, the gel-pack is composed of an upper 4 and lower 5 layer of a plastic material, holding a freezer gel material 6. The gel-pack has a heat welded perimeter seam 7, and head welded seams 8 around each hole 2 (see also FIG. 1)

FIGS. 5 to 9 show a variety, but not an exhaustive list of alternate embodiments of the gel-pack of the present invention, designed to fit in a variety of commercially available and relatively common cartons. In each, the layout of holes 2 corresponds with the positions of the necks of bottles in a carton full of bottles. It will be understood, moreover, that some carton configurations may be covered by using more than one gel pack. For instance, a carton containing a 3×4 array of bottles may be effectively covered using two 2×3 gel-packs shown in FIG. 9, laid side by side. Moreover, the gel-packs of the present invention may be laid in overlapping fashion on an array of bottles, or may be laid on an array of bottles in multiple layers, if more or extended cooling is desired.

Figure 10:
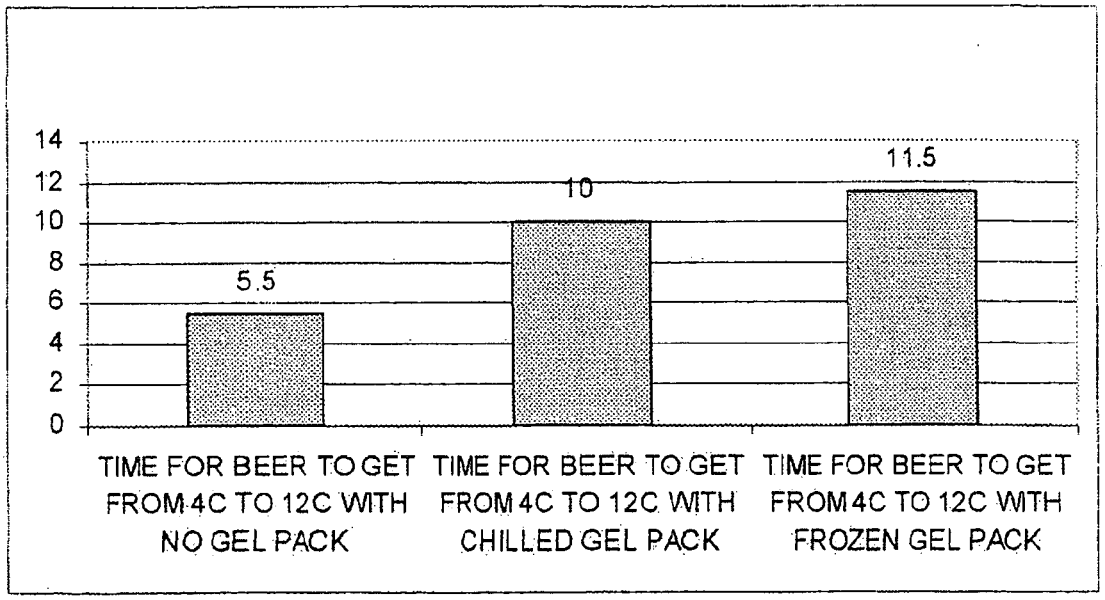
FIG. 10 is a graph illustrating times for warming of a beverage with and without the use of the gel-pack of the present invention.

A test to determine the efficacy of the gel-pack of the present invention was conducted as follows:

Three cartons, each containing 24 glass bottles of beer, at 4° C. were brought into a room temperature (20° C.) environment. One carton was not provided with a gel-pack. One carton was provided with a gel-pack according to the present invention, chilled to 4° C. in a refrigerator. On carton was provided with a gel-pack according to the present invention, chilled to −4° C. in a freezer. Bottles were extracted from each carton at 0.5 minute intervals, and the temperature of the contents measured, with a view to determining the time it would take the contents to reach 12° C. The results are summarized in the graph presented in FIG. 10. As will be readily appreciated, the use of a chilled or frozen gel-pack resulted in a substantial delay in the time necessary for a beverage to warm up, under normal room temperature conditions.

The gel-pack of the present invention may be made from an envelope of any suitable plastic material, as will be an obvious matter of choice to one skilled in the art. PVC and polyethylene are suitable choices. The gel material may be any suitable and approved freezer gel material formula, such as 84.9% water, 10% propylene glycol, 5% carboxymethyl cellulose sodium, and 0.03% methylochoroiso-thiazolinone and methylisothiazolinone. The edges of the plastic envelope, including all hole edges, are heat welded.

What is claimed is:

1. A gel-pack for chilling bottled beverages comprising:

a flexible plastic envelope, sealed around its perimeter, provided with a spaced array of holes therethrough whereby said gel-pack can be draped over a plurality of beverage bottles, with the necks of said bottles protruding through said holes in said gel-pack;

wherein said envelope contains a predetermined quantity of a food grade freezable gel; and wherein said gel comprises water, propylene glycol and sodium carboxymethyl cellulose.

* * * * *